US008209781B2

(12) United States Patent
Krochmal

(10) Patent No.: US 8,209,781 B2
(45) Date of Patent: Jul. 3, 2012

(54) PROTECTIVE EARFLAP UNIT

(76) Inventor: Jeffrey P. Krochmal, Boise, ID (US)

( * ) Notice: Subject to any disclaimer, the term of this patent is extended or adjusted under 35 U.S.C. 154(b) by 734 days.

(21) Appl. No.: 12/263,306

(22) Filed: Oct. 31, 2008

(65) Prior Publication Data

US 2010/0107305 A1 May 6, 2010

(51) Int. Cl.
*A42B 1/24* (2006.01)

(52) U.S. Cl. ..... 2/422; 2/8.1; 2/423

(58) Field of Classification Search ..... 2/5, 455, 2/410, 7, 8.1, 422, 423, 468, 209
See application file for complete search history.

(56) References Cited

U.S. PATENT DOCUMENTS

| | | | | | |
|---|---|---|---|---|---|
| 889,640 | A | | 6/1908 | Sherman | |
| 2,055,560 | A | | 9/1936 | Rose | |
| 2,192,341 | A | | 3/1940 | Dahlberg | |
| 2,897,510 | A | | 8/1959 | Forbes-Robinson | |
| 3,046,560 | A | * | 7/1962 | De Grazia | 2/6.6 |
| 4,829,599 | A | * | 5/1989 | Giorgio et al. | 2/5 |
| 4,932,076 | A | * | 6/1990 | Giorgio et al. | 2/5 |
| 4,975,980 | A | * | 12/1990 | Ersteniuk | 2/5 |
| 5,046,195 | A | | 9/1991 | Koritan | |
| 5,123,115 | A | * | 6/1992 | Braswell-Moore | 2/10 |
| 5,161,259 | A | | 11/1992 | Shorts | |
| 5,437,613 | A | * | 8/1995 | Reggio et al. | 602/18 |
| 5,461,727 | A | * | 10/1995 | Braswell-Moore | 2/171 |
| 5,493,734 | A | * | 2/1996 | Nieves-Rivera | 2/209.13 |
| 5,517,691 | A | | 5/1996 | Blake | |
| 5,522,091 | A | * | 6/1996 | Rudolf | 2/6.2 |
| 5,647,061 | A | * | 7/1997 | Marcus | 2/11 |
| 5,649,327 | A | * | 7/1997 | Crewe | 2/172 |
| 5,701,609 | A | | 12/1997 | Bridges | |
| 5,926,854 | A | | 7/1999 | Grilliot | |
| 5,996,124 | A | * | 12/1999 | Asp, Jr. | 2/209.13 |
| 6,021,525 | A | | 2/2000 | Mertins | |
| D431,709 | S | | 10/2000 | Cupps | |
| 6,163,886 | A | | 12/2000 | Carter | |
| D474,327 | S | | 5/2003 | Giesen | |
| D481,198 | S | | 10/2003 | McKnight | |
| D490,969 | S | | 6/2004 | Kobayashi | |
| 6,802,083 | B2 | | 10/2004 | Yan | |
| 6,808,146 | B2 | | 10/2004 | Swan | |
| D504,004 | S | | 4/2005 | Cashin | |
| D509,046 | S | | 9/2005 | Patterson | |
| 7,310,829 | B1 | | 12/2007 | Engel-Wilson | |

OTHER PUBLICATIONS

Unknown Author, Bullard Fire & Rescue Helmets & Accessories, ??-??-2006, 16 pages, Bullard, Cynthiana, KY, U.S.A.

Unknown Author, Cairns Purchasing Specification Structural Firefighters Helmet Cairns 1044, 1971-2000 Revision, Jan. 1, 2005, 4 pages, Cairns, U.S.A.

Unknown Author, Cairns Modern Helmets Bulletin, 09-??-2004, 4 pages, Cairns, Pittsburgh, PA, U.S.A.

Unknown Author, Bullard Firedome Firefighter Helmet Replacement Parts Installation Instructions, ??-??-2000, 4 pages, Bullard, Cynthiana, KY, U.S.A.

* cited by examiner

*Primary Examiner* — Christopher Harmon
(74) *Attorney, Agent, or Firm* — Charles R. Clark

(57) ABSTRACT

During use of a firefighter helmet or a similar helmet, a detachable protective earflap unit can be used to provide convenient and easy storage of personal items for the firefighter or other helmet wearer secured at the back of the helmet and below the rear brim or rear lower edge of the helmet by a utility strap securement assembly. The protective earflap unit comprises an earflap having a utility strap securement assembly that selectively may encircle and retain eyewear, an eyewear case, a utility bag, or other small personal item.

16 Claims, 4 Drawing Sheets

PROTECTIVE EARFLAP UNIT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to a novel detachable protective earflap unit having a utility strap securement assembly useful for the convenient and immediately accessible securement of eye wear or a utility bag containing small personal items or other personal items such as gloves at the rear and below the rear brim of a prior art firefighter helmet having an inner helmet or other similar helmet.

BRIEF SUMMARY OF THE INVENTION

The present invention relates to a novel detachable protective earflap unit comprising an earflap having a utility strap securement assembly attached at the outer rear upper midpoint of the earflap. An objective of this invention, a protective earflap unit having a utility strap securement assembly, is to provide a firefighter or other helmet wearing person with convenient and immediately accessible securement of eye wear or a utility bag containing small personal items or other personal items such as gloves attached to a firefighter helmet at the rear and below the rear brim of the firefighter helmet or other similar helmet.

Ergonometric advantages for a firefighter are promoted because with the instant invention, the firefighter is provided with convenient and immediately accessible storage attached to his helmet on the outside of the protective earflap unit and the firefighter does not need to fumble with obtaining access to other storage pockets within the firefighter's turnout coat or other protective clothing items.

The protective earflap unit having a utility strap securement assembly can be made from suitable heat-resistant and flame-resistant fabrics, heat-resistant and flame-resistant hook and loop closures, and suitable elastic band material. Other suitable materials including snaps and zippers could be substituted in place of corresponding hook and loop closures without departing from the intended scope of the invention. Suitable heat-resistant and flame-resistant fabrics may include Nomex® fabric, PBI/Kevlar® fabric, or other similar fabrics.

Additional and various other objects and advantages attained by the invention will become more apparent as the specification is read and the accompanying figures are reviewed.

DETAILED DESCRIPTION OF THE INVENTION

Figure 1:
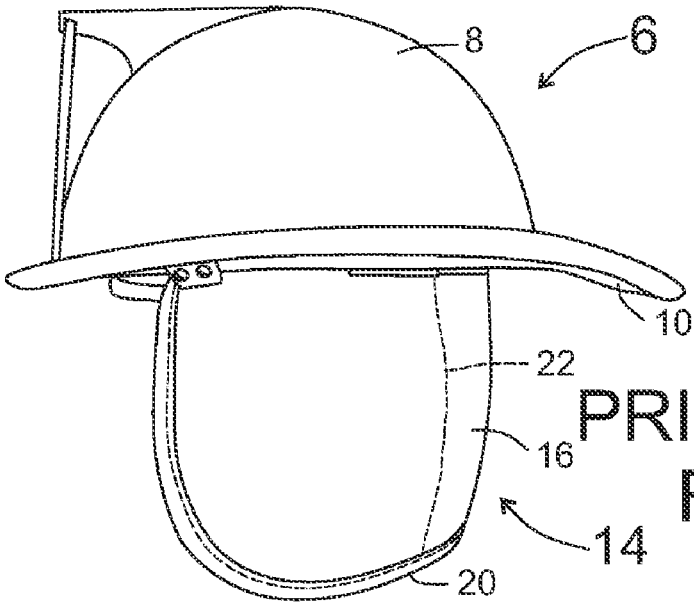
PRIOR ART FIG. 1
FIG. 1 is a side view of a firefighter helmet 6 showing a prior art detachable earflap 14.
Figure 2:
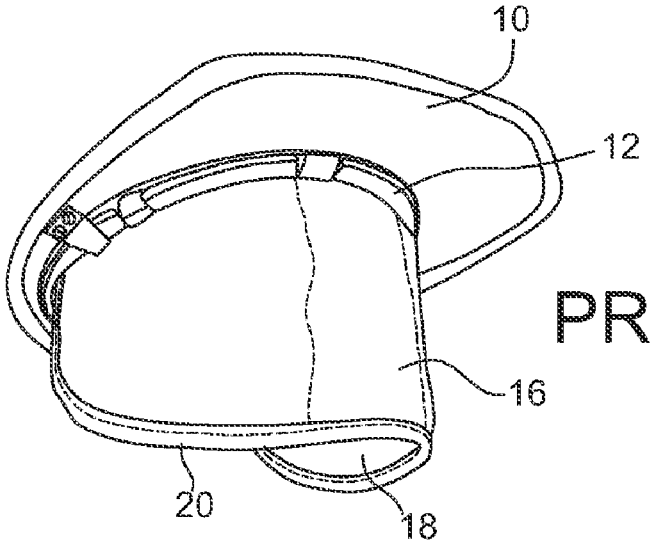
PRIOR ART FIG. 2
FIG. 2 is a perspective view from below of the helmet shown in FIG. 1.
Figure 3:
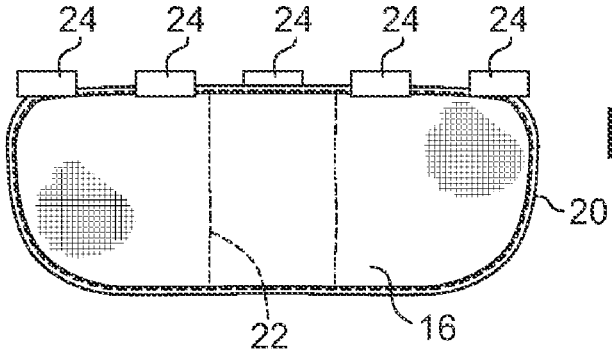
PRIOR ART FIG. 3
FIG. 3 is a top plan view of the prior art detachable earflap 14 shown in FIGS. 1 and 2.

Referring to FIGS. 1 through 19, a firefighter helmet 6 having an outer helmet shell 8 with a rear brim 10 and an inner helmet 12 can be equipped with a detachable protective earflap unit 25 comprising an earflap 14 having a utility strap securement assembly 30 for the securement to the helmet of eyewear or other personal items.

The protective earflap unit 25 comprises an earflap 14 having an outer fabric layer 16 overlaid and attached to an inner fabric layer 18, preferably with a fabric edge piping 20 covering and attached over the edges of the fabric layers by stitching 22, a plurality of earflap attachment pads 24 distributed and attached along the upper edge of the earflap and distributed about a midpoint earflap attachment pad 26, each earflap attachment pad attached to the upper edge of the earflap preferably by stitching, a plurality of complementary inner helmet attachment pads 28 for attachment in the preferred embodiment to the inner surface of the inner helmet 12 of a firefighter helmet for cooperation respectively with corresponding earflap attachment pads, a utility strap securement assembly 30 comprising a strap 31 having an inner side and an outer side and the strap having an upper strap portion 32 and a lower strap portion 34, a strap pull tab 36 at the distal end of the upper strap portion, an upper strap portion attachment pad 38 attached preferably by stitching to the inner side of the strap below the strap pull tab, a strap anchor attachment pad 40 attached to the inner side of the strap spaced below the upper strap portion attachment pad, a distal lower strap portion attachment pad 42 attached to the outer side of the strap at or near the distal end of the lower strap portion, a medial lower strap portion attachment pad 44 attached to the outer side of the strap between the midpoint of the strap and the distal lower strap portion attachment pad.

Figure 7:
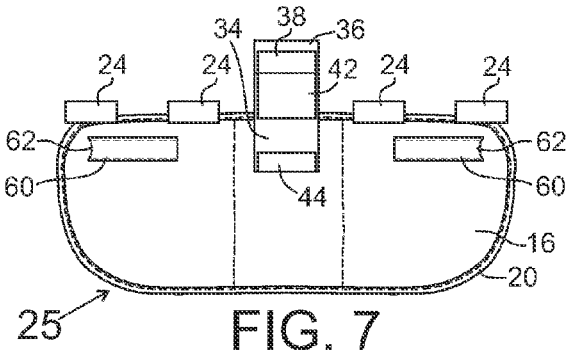
FIG. 7 is a top plan view of the protective earflap unit 25 shown in FIGS. 4 and 5 showing the utility strap securement assembly 30 in a partially open condition with a lower strap portion 34 folded up and overlapping an upper strap portion 32.
Figure 8:
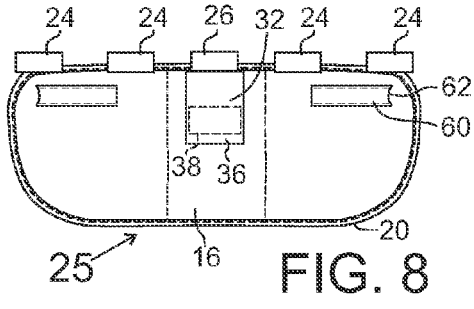
FIG. 8 is a top plan view of the protective earflap unit 25 shown in FIGS. 4 and 5 showing the utility strap securement assembly 30 in a fully closed condition.
Figure 9:
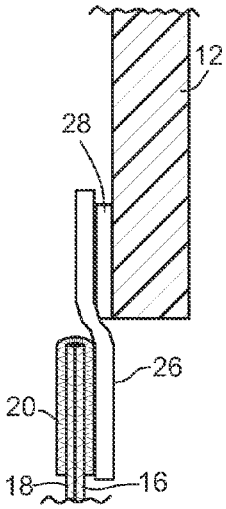
FIG. 9 is a partial cross-sectional view of an upper portion of the protective earflap unit showing a midpoint earflap attachment pad 26 attached to an inner helmet attachment pad 28.

Referring to FIGS. 7 and 8, the medial lower strap portion attachment pad 44 (a loop pad) provides a complementary attachment pad for selectively engaging the upper strap portion attachment pad 38 (a hook pad) when a very small object or no object is secured within the securement assembly 30.

Figure 6:
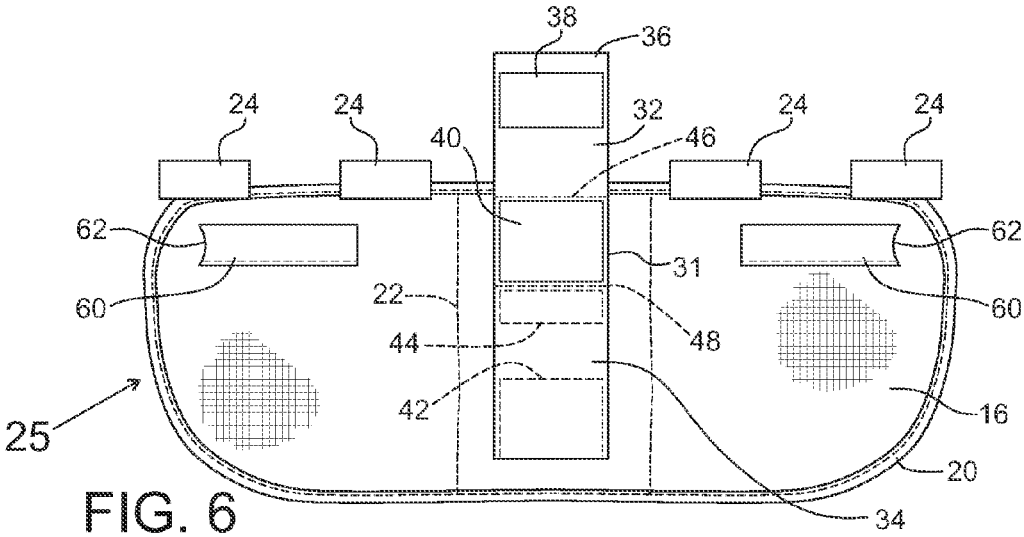
FIG. 6 is a top plan view of the protective earflap unit 25 shown in FIGS. 4 and 5 showing the utility strap securement assembly 30 in a fully open condition.

The strap 31 preferably is made from a single layer of soft Nomex® fabric with the edges folded over and suitably stitched to preclude unraveling. The strap can be made from other suitable heat-resistant and flame-resistant fabrics. A portion of the outer side of the strap 31 is attached to the outer surface of the earflap 14 by stitching using heat-resistant and flame-resistant thread such as Kevlar® thread. FIG. 6 shows an upper attaching stitching 46 attaching the upper strap portion 32 to the earflap below the upper edge of the earflap and shows a lower attaching stitching 48 attaching the lower strap portion 34 to the earflap below the strap anchor attachment pad 40.

Alternatively, the strap 31 could be made as a multilayer strap made of two or more overlaying layers of Nomex® fabric or other suitable fabric stitched together.

Figure 10:
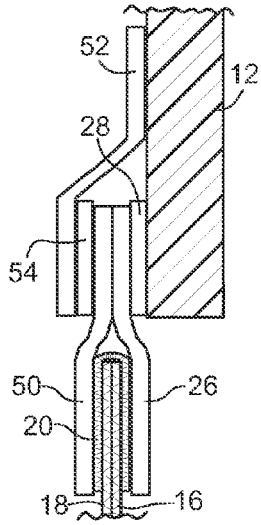
FIG. 10 is a partial cross-sectional view of the upper portion of the protective earflap unit showing a midpoint earflap attachment pad 26 attached to a complementary inner helmet attachment pad 28 and partially attached back to back to a second midpoint earflap attachment pad 50, the second midpoint earflap attachment pad attached to a complementary inner helmet sandwiching attachment pad 54.

A second midpoint earflap attachment pad 50 can be attached to the backside of the midpoint earflap attachment pad 26 and an inner helmet sandwiching attachment pad connecting strap 52 can be attached to the inner helmet to secure an inner helmet sandwiching inner helmet attachment pad 54 for cooperation with the second midpoint earflap attachment pad as shown in FIG. 10 with the helmet attachment pads sandwiching the cooperating earflap attachment pads between the helmet attachment pads.

An alternative embodiment of the earflap unit would incorporate similar sandwiching structures as disclosed in the immediately preceding paragraph for use with respect to each of the plurality of earflap attachment pads 24 to attach the earflap unit to the inner helmet.

Preferably the attachment pads are complementary hook and loop closures with the earflap attachment pads 24 and 26 being loop pads and the helmet attachment pads 28 being hook pads. Of course the earflap attachment pads could be hook pads and the helmet attachment pads could be loop pads.

Preferably, two generally rectangularly shaped marking utensil sleeves 60 each made from heat-resistant and flame-resistant fabric and each sleeve having a forward facing open end 62 are attached by stitching one sleeve to each outer upper surface of the earflap 14 and each sleeve sized to receive and selectively retain a marking utensil such as a Sharpie® pen, a pen, a pencil, a Magic Marker® marker, other writing implement, or a similarly shaped personal item for convenient and easy access by the firefighter or other user.

Figure 4:
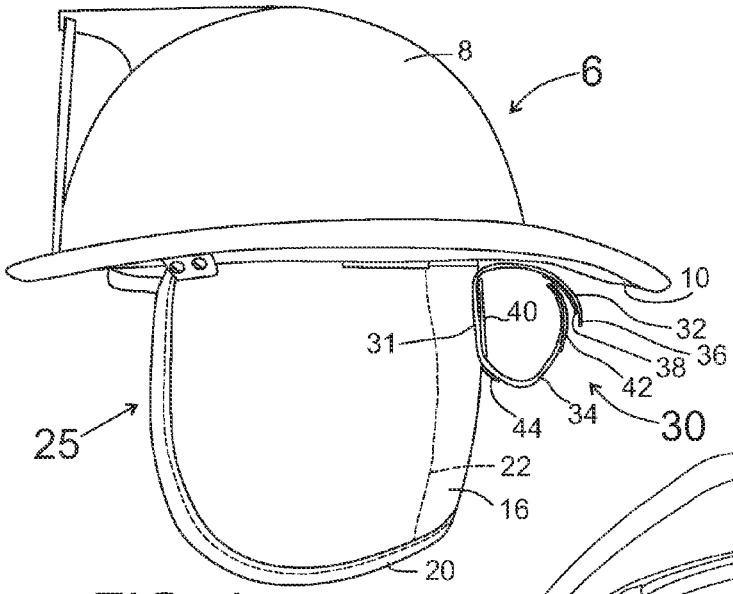
FIG. 4 is a side view of a firefighter helmet 6 showing a detachable protective earflap unit 25 having a utility strap securement assembly 30.
Figure 5:
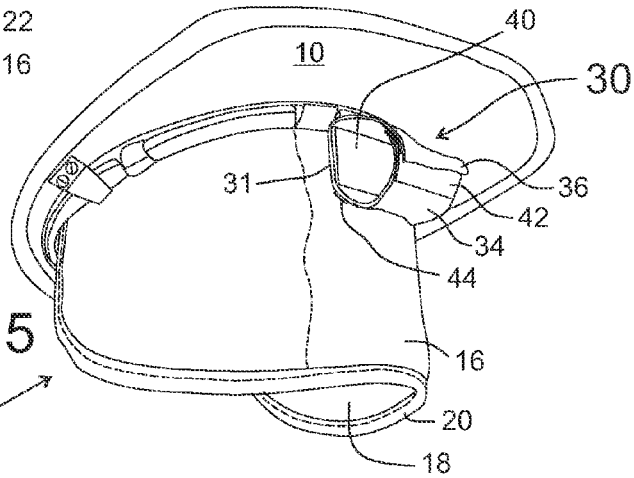
FIG. 5 is a perspective view from below of the helmet shown in FIG. 4.
Figure 11:
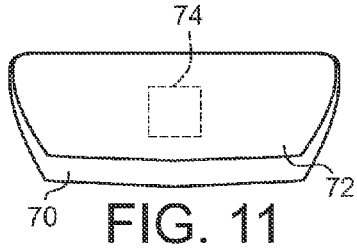
FIG. 11 is a front view of an eyewear case 70 having an access flap 72.
Figure 12:
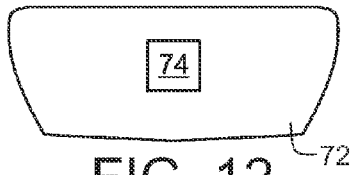
FIG. 12 is a rear view of the eyewear case 70 shown in FIG. 11 having an attaching pad 74.
Figure 15:
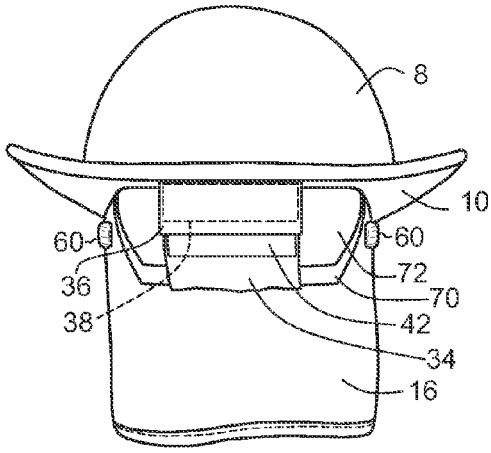
FIG. 15 is a rear view of a firefighter helmet 6 having a detachable earflap unit attached and showing the utility strap securement assembly 30 securing an eyewear case 70.

FIGS. 11 and 12 show a conventional eyewear case 70 having an access flap 72 for the enclosed eyewear and an attaching pad 74 for complementary cooperation with the strap anchor attachment pad 40 as shown in FIGS. 4, 5, and 6. FIG. 15 shows an eyewear case 70 secured within the grasp of the utility strap securement assembly 30 by the cooperating engagement of the upper strap portion attachment pad 38 and the distal lower strap portion attachment pad 42. Preferably, the upper strap portion attachment pad 38 is a hook pad and the complementary lower strap portion attachment pad 42 is a loop pad of a cooperating hook and loop closure.

Figure 13:
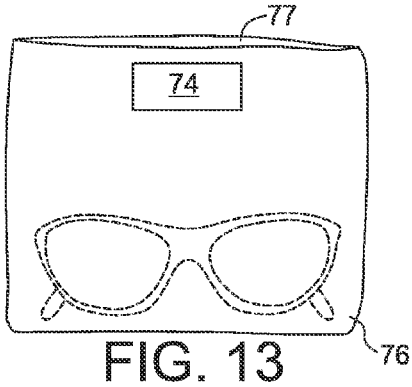
FIG. 13 is a front view of a general utility bag 76 having an open end 77 showing a pair of eyeglasses enclosed within the bag.
Figure 16:
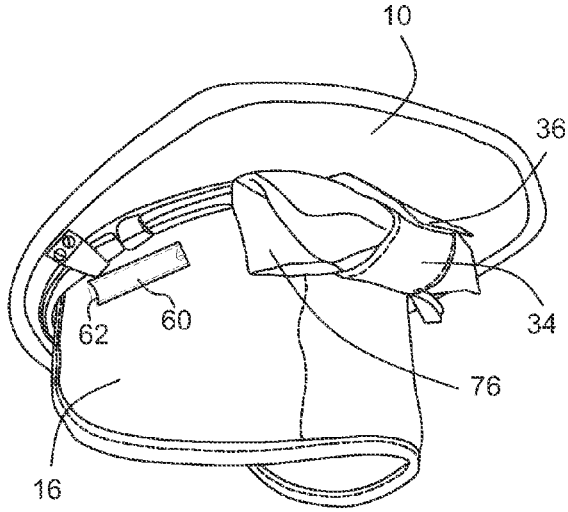
FIG. 16 is a perspective view from below of a firefighter helmet 6 showing the utility strap securement assembly 30 securing a general utility bag 76 folded about its contents.

FIG. 13 shows a general utility bag 76 preferably made of a soft, heat-resistant and flame-resistant fabric having a general utility bag open end 77 and having an attaching pad 74 for cooperation with the strap anchor attachment pad 40 as shown in FIGS. 4, 5, and 6. FIG. 16 shows a general utility bag 76 secured within the grasp of the utility strap securement assembly 30 by the cooperating engagement of the upper strap portion attachment pad 38 and the distal lower strap portion attachment pad 42. Preferably, the upper strap portion attachment pad 38 is a hook pad and the complementary lower strap portion attachment pad 42 is a loop pad of a cooperating hook and loop closure.

Figure 14:
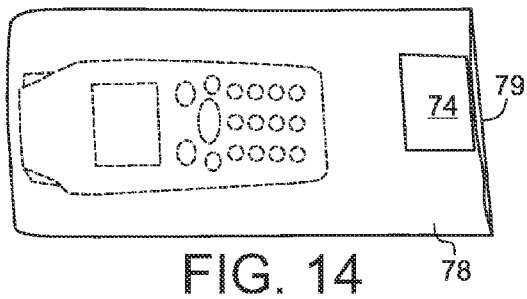
FIG. 14 is a front view of an elongate utility bag 78 having an open end 79 showing a cell phone enclosed within the bag.
Figure 17:
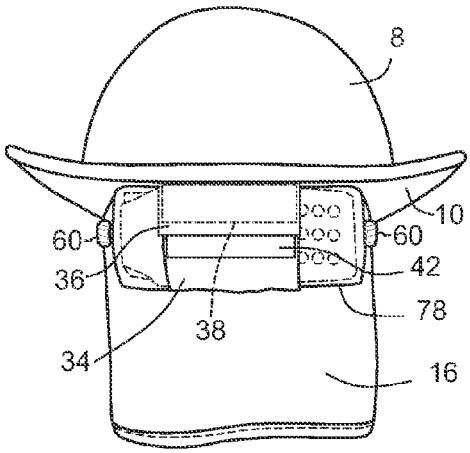
FIG. 17 is a rear view of a firefighter helmet 6 showing the utility strap securement assembly 30 securing an elongate utility bag 78 folded about its contents, a cell phone.
Figure 18:
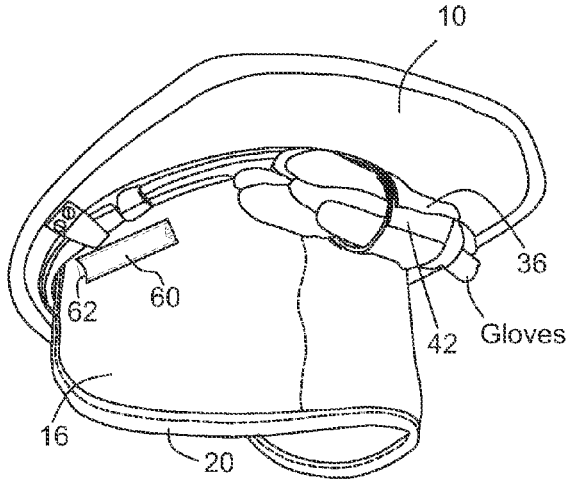
FIG. 18 is a perspective view from below of a firefighter helmet 6 showing the utility strap securement assembly 30 securing a pair of gloves.

FIG. 14 shows an elongate utility bag 78 preferably made of a soft, heat-resistant and flame-resistant fabric having an elongate utility bag open end 79 and having an attaching pad 74 for cooperation with the strap anchor attachment pad 40 as shown in FIGS. 4, 5, and 6. FIG. 17 shows an elongate utility bag 78 secured within the grasp of the utility strap securement assembly 30 by the cooperating engagement of the upper strap portion attachment pad 38 and the distal lower strap portion attachment pad 42. Preferably, the upper strap portion attachment pad 38 is a hook pad and the complementary lower strap portion attachment pad 42 is a loop pad of a cooperating hook and loop closure.

Figure 19:
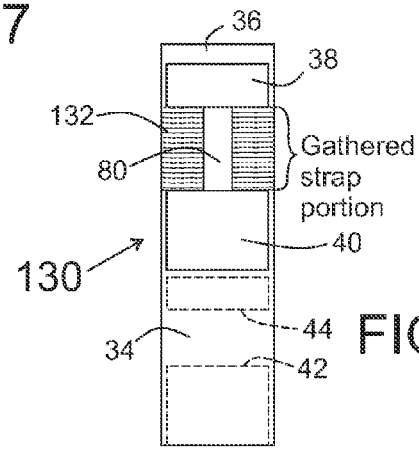
FIG. 19 is a top plan view of an alternative utility strap securement assembly 130 in a relaxed condition showing a gathered strap portion 132 of the upper strap portion 32 gathered by a relaxed elastic band member 80.

As shown in FIG. 19, an alternative utility strap securement assembly 130 can be made that includes an longitudinal elastic band member 80 stitched at each end of the member into the strap that elastically gathers a longitudinal portion of the strap as a gathered portion 132, the longitudinal portion can be stretched longitudinally during the encirclement and closure around contents such as an eyewear case or a pair of gloves or a utility bag, and after closure as the band member attempts to return to the unstretched condition, the securement assembly snugs around the contents selectively placed within its structure.

Alternatively, the strap 31 could be made of longitudinally elasticized heat-resistant and flame-resistant fabrics to promote the snugging of the utility strap securement assembly 30 around an object or objects to be secured within the securement assembly.

Preferably, the outer fabric layer 16 of the earflap unit is made of a heat-resistant and flame-resistant fabric such as a Nomex® fabric, PBI/Kevlar® fabric, or another suitable fabric. Preferably, the inner fabric layer 18 is made of a Nomex® fabric, a cotton flannel fabric (treated to be heat-resistant and flame-resistant), or another suitable fabric. Preferably, all stitching used in the earflap unit comprises a heat-resistant and flame-resistant thread such as Kevlar® thread or another suitable thread.

Preferably, the strap anchor attachment pad 40 is a loop pad for cooperation with complementary hook attachment pads such as attaching pads 74.

Alternatively, the detachable earflap unit could be used with other helmets or hats such as hard hats, bicycle helmets, or ball caps. When used in a low heat and no flame environment, the earflap unit can be manufactured from simple fabrics such as cotton fabric or other suitable fabrics and from materials that are not heat-resistant and not flame-resistant.

The detachable earflap unit could be used with other helmets or hats that do not have an inner helmet. In such an alternative embodiment, the inner helmet attachment pads 28 could be replaced by attachment pads attached to the helmet or hat along the lower edge of the helmet or hat either inside or outside of the helmet or hat for cooperating engagement with respective earflap attachment pads 24 and 26.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A protective earflap unit for a helmet comprising an earflap having a utility strap securement assembly attached at the outer rear upper midpoint of said earflap and a plurality of earflap attachment pads distributed and attached along the upper edge of said earflap and distributed about a midpoint earflap attachment pad, said midpoint earflap attachment pad attached to the upper edge of said earflap at its midpoint, said utility strap securement assembly comprising a strap having an inner side and an outer side and said strap having an upper strap portion and a lower strap portion, a strap pull tab at the distal end of said upper strap portion, an upper strap portion attachment pad attached to said inner side of said strap below said strap pull tab, a distal lower strap portion attachment pad attached to said outer side of said strap at or near the distal end of said lower strap portion;

whereby said utility strap securement assembly provides for the securement to said helmet of eyewear or other personal items by the cooperating engagement of said upper strap portion attachment pad and said distal lower strap portion attachment pad.

2. A protective earflap unit according to claim 1 further comprising a strap anchor attachment pad attached to said inner side of said strap spaced below said upper strap portion attachment pad.

3. A protective earflap unit according to claim 2 further comprising a medial lower strap portion attachment pad attached to said outer side of said strap between the midpoint of said strap and said distal lower strap portion attachment pad.

4. A protective earflap unit according to claim 3 wherein said earflap having an outer fabric layer overlaid and attached to an inner fabric layer.

5. A protective earflap unit according to claim 4 wherein said outer fabric layer comprising a heat-resistant and flame resistant fabric.

6. A protective earflap unit according to claim 5 wherein said inner fabric layer comprising a heat-resistant and flame resistant fabric.

7. A protective earflap unit for a helmet comprising an earflap having a utility strap securement assembly attached at the outer rear upper midpoint of said earflap and a plurality of earflap attachment pads distributed and attached along the upper edge of said earflap and distributed about a midpoint earflap attachment pad, said midpoint earflap attachment pad attached to the upper edge of said earflap at its midpoint, said utility strap securement assembly comprising a strap having an inner side and an outer side and said strap having an upper strap portion and a lower strap portion, a strap pull tab at the distal end of said upper strap portion, an upper strap portion attachment pad attached to said inner side of said strap below said strap pull tab, a distal lower strap portion attachment pad attached to said outer side of said strap at or near the distal end of said lower strap portion, a strap anchor attachment pad attached to said inner side of said strap spaced below said upper strap portion attachment pad, a medial lower strap portion attachment pad attached to said outer side of said strap between the midpoint of said strap and said distal lower strap portion attachment pad, said earflap having an outer fabric layer overlaid and attached to an inner fabric layer, said outer fabric layer comprising a heat-resistant and flame resistant fabric, said inner fabric layer comprising a heat-resistant and flame resistant fabric, a utility bag having a utility bag open end and having an attachment pad for cooperation with said strap anchor attaching pad; whereby said utility strap securement assembly provides for the securement to said helmet of eyewear or other personal items by the cooperating engagement of said upper strap portion attachment pad and said distal lower strap portion attachment pad.

8. A protective earflap unit according to claim 7 wherein said utility bag made of a soft, heat-resistant and flame-resistant fabric.

9. A protective earflap unit according to claim 1 wherein said utility strap securement assembly further comprising an elastic band member.

10. A protective earflap unit for a helmet comprising an earflap having a utility strap securement assembly attached at the outer rear upper midpoint of said earflap, said utility strap securement assembly comprising a strap having an inner side and an outer side and said strap having an upper strap portion and a lower strap portion, a strap pull tab at the distal end of said upper strap portion, an upper strap portion attachment pad attached to said inner side of said strap below said strap pull tab, a strap anchor attachment pad attached to said inner side of said strap spaced below said upper strap portion attachment pad, a distal lower strap portion attachment pad attached to said outer side of said strap at or near the distal end of said lower strap portion, a medial lower strap portion attachment pad attached to said outer side of said strap between the midpoint of said strap and said distal lower strap portion attachment pad;

whereby said utility strap securement assembly provides for the securement to said helmet of eyewear or other personal items by the cooperating engagement of said upper strap portion attachment pad and said distal lower strap portion attachment pad.

11. A protective earflap unit according to claim 10 wherein said earflap having an outer fabric layer overlaid and attached to an inner fabric layer.

12. A protective earflap unit according to claim 11 wherein said outer fabric layer comprising a heat-resistant and flame resistant fabric.

13. A protective earflap unit according to claim 12 wherein said inner fabric layer comprising a heat-resistant and flame resistant fabric.

14. A protective earflap unit according to claim 13 further comprising a utility bag having a utility bag open end and having an attachment pad for cooperation with said strap anchor attachment pad.

15. A protective earflap unit according to claim 14 wherein said utility bag made of a soft, heat-resistant and flame-resistant fabric.

16. A protective earflap unit according to claim 15 wherein said utility strap securement assembly further comprising an elastic band member.

* * * * *